United States Patent [19]

Teasdale

[11] Patent Number: 5,007,225

[45] Date of Patent: Apr. 16, 1991

[54] CONSTRUCTION OF LARGE SANDWICH STRUCTURES

[75] Inventor: James A. Teasdale, Newcastle upon Tyne, England

[73] Assignee: British Shipbuilders, England

[21] Appl. No.: 64,255

[22] PCT Filed: Sep. 29, 1986

[86] PCT No.: PCT/GB86/00579

§ 371 Date: Jul. 21, 1987

§ 102(e) Date: Jul. 21, 1987

[87] PCT Pub. No.: WO87/02086

PCT Pub. Date: Apr. 9, 1987

[30] Foreign Application Priority Data

Sep. 27, 1985 [GB] United Kingdom ..... 8523933

[51] Int. Cl.[5] ..... E04C 2/32

[52] U.S. Cl. ..... 52/799; 52/800

[58] Field of Search ..... 52/799, 795, 800, 801, 52/650, 797; 244/123

[56] References Cited

U.S. PATENT DOCUMENTS

| | | | |
|---|---|---|---|
| 1,925,453 | 9/1933 | Mazer | 52/799 |
| 2,576,530 | 11/1951 | Medal | 52/799 |
| 2,616,283 | 11/1952 | Branstrator et al. | 52/795 |
| 2,641,029 | 6/1952 | Trimmer | 52/799 |
| 2,746,139 | 5/1956 | Pappelendam | 52/799 |
| 3,217,845 | 11/1965 | Reynolds | 52/799 |
| 4,070,839 | 1/1978 | Clem | 52/799 |
| 4,530,197 | 7/1985 | Rainville | 52/799 |
| 4,550,545 | 11/1985 | Schulz | 52/799 |

FOREIGN PATENT DOCUMENTS

| | | | |
|---|---|---|---|
| 2449190 | 10/1980 | France | 52/799 |
| 698599 | 11/1965 | Italy | 52/799 |
| 705907 | 5/1966 | Italy | 52/799 |
| 742557 | 6/1980 | U.S.S.R. | 52/801 |
| 125762 | 5/1919 | United Kingdom | 52/799 |

*Primary Examiner*—Michael Safavi

*Attorney, Agent, or Firm*—Leydig, Voit & Mayer

[57] ABSTRACT

Composite metal panels comprise two parallel plates 1, 2 each laser-welded to an internally sandwiched corrugated stiffener plate 3. Typically, all the welds 6*a*, 6*b* are in the same sense; firstly, penetrating laser welds 6*b* are made along and through the troughs 5 of the corrugations into (or, less preferably, through) an underlying plate 2 and secondly welds 6*a* are made along and through an overlying plate 1 along and into or through the peaks of the corrugations 4. Such a panel can be readily fabricated into large-scale metal constructions, especially ships.

4 Claims, 7 Drawing Sheets

CONSTRUCTION OF LARGE SANDWICH STRUCTURES

This invention relates to the construction of large sandwich metal structures from plate material.

It has particular application to ship building, in which composite metal structures incorporating metal plate are used in hull, superstructure, deckhouse, bulkhead or hatch fabrication etc, and accordingly the invention will be described below primarily in such a context. However, the invention also has utility in respect of other structures such as linkspans, bridges, oil rigs, offshore structures, platforms, containers, buildings, columns, pontoons, tubes, pipes, and like large welded constructions.

In the construction of ships, the basic unit of the hull or bulkhead construction and other parts of ship construction is conventionally a composite panel. Such a panel is typically made by (a) cutting up plate material into predetermined sizes (b)butt-welding together the edges of a number of such plates, and (c) applying stiffener bars parallel to (or across) the butt welds. This forms a stiffened panel, stiffened by the bars which are of various cross sections but often rather L-shaped in cross-section with a short foot portion integral with a long shank portion projecting from the panel. Such panels can be further fabricated using large dimension connecting webs welded to the plates at right angles and/or parallel to the stiffeners, and possibly also mounting another such stiffened plate opposed to the first to form a double skin compartment.

Conventionally a number of different weld techniques are used in this construction such as butt welding, fillet welding, overhead welding and the like. The process can moreover involve major lifting and turning of the panel during its construction and/or can involve the need for welding operatives to work in confined internal spaces of a double skin. Our own earlier Patent Applications discuss weld techniques involving lasers to rationalise and facilitate these known methods.

These earlier laser techniques were however confined to utilising lasers in such a way as to produce a composite article of more or less conventional overall appearance (that is to say conventional apart from details of the weld) which can be utilised as it stands in existing structures.

We have now discovered a generally new construction of composite panel; methods for its fabrication; methods for its onward utilisation (that is to say, joining up with similar such composites); details of fixing, repair and transition techniques using such composites; and, in general, a new type of sandwich large-scale metal construction, especially of ship construction, using such a composite.

In one aspect the invention provides a ship or like large-scale metal construction in which structural, subdividing, or enclosing, hulls, bulkheads, deckhouses or like structures comprise composite metal panels consisting of two parallel plates secured to the peaks and troughs respectively of a corrugated metal stiffener plate arranged between the parallel plates.

The type of structure defined above can be used alone, for example, for bulkheads, or like sub-division or cladding elements. However, two or more such structures can themselves be linked together and form a parallel composite to define a hull compartment including sub-divisions.

In another aspect the invention comprises a composite metal panel comprising two parallel plates secured to the peaks and troughs respectively of a sandwiched corrugated metal stiffener plate by weld lines extending along the peaks and troughs.

Such a panel is a preferred constructional element of the ship construction and others as defined above.

Although the techniques of the invention can be used over a wide range of thicknesses, generally speaking plates from 1 to 25 millimetres thickness are envisaged for the component parts of the composite panel applied to ships. For other applications greater thickness may be required. It will be found usually preferable to have the two parallel plate portions each thicker than the metal thickness of the corrugated plate portion.

The spacing of the corrugations (that is to say, the distance between corresponding points of one corrugation and the next) taken as a ratio to the separation of the parallel plates can vary again over wide ranges but is preferably within the range of 1.5:1 to 1:1.5. More preferably it lies within a closer range, of 1.1:1 to 1:1.1, that is to say about unity from a production standpoint. Weight and strength considerations in different applications may require a wider range of this ratio.

It is a preferable feature of the invention that the corrugated sheet between the panels has flat peaks and troughs. The external width measurement of the flat peak where adopted is not limited but from a production standpoint preferably lies between the ranges of 1:3 to 1:7, that is to say, an average of about 1:5, in relation to the plate spacing. Again, weight and strength considerations in different applications may require a wider range of this ratio. The area in contact of course will be narrower by virtue of the thickness of, and the radius of any bend in, of the corrugated plate.

The weld lines fixing the parallel plates and corrugated plates together are most preferably those formed by laser through-welds, of the type provided by passing a high-intensity laser beam into or through both layers of metal and along the position of the peak or trough. Most valuably, the through welds are provided all in one sense, that is to say so that successive welds pass through (a) trough material then surface plate material and (b) plate material then peak material. To facilitate this, and as a further aspect of the invention a design of plasma control device has been produced which will allow a gas-supplying shoe into the valley of a corrugated profile to improve laser through-welding of the corrugated stiffener plate of the lower parallel plate. Such an arrangement, as described in more detail below, allows a single weld orientation to be used and the avoidance of turning over of the composite panel structure halfway through its manufacture.

More particularly, the plate preferably has along one surface a number of weld lines which pass through the surface plate and into an underlying peak; and on the other surface no visible weld lines but an internal weld line structure each line of which passes through a trough and into the material of the plate without however totally penetrating that material. This gives a composite panel with weld lines on one face but smooth surfaces on the other face. Of course, in a particular application it may be required that a weld should completely penetrate through a facing plate.

The construction of the sandwich structure will not (in normal workshop or site conditions) prevent gaps occurring between, on the one hand, the troughs and peaks of the corrugated plate, and, on the other, the face plates. The preferred method of welding using a high-power density laser beam also however allows the addition of material to run into and fill the gaps between the plates making the sandwich panel. One method of adding material to fill the gap is by wire feed. The addition of wire feed also makes it possible to obtain a fine control over production as described in our earlier Applications such as U.S. Patent applications 601 424, 604 079 and other Applications equivalent to, or divided or continued from such Applications.

The product of the present invention is referred to as a sandwich composite panel of plate material. It is an understood terminology that plate material, in the metallurgical art, is a thicker, denser and more dimensionally stable and stiff grade of material than sheet material. Typically plate thickness lies within the range of 1 to 25 millimetres as defined above, although in certain circumstances may extend above or below these limits.

Most typically, but not by way of limitation the sandwich composite is of a thickness such that the spacing between the external plates lies between 25 and 200 millimetres, more preferably between 50 and 150 millimetres or, in a preferred standardised embodiment about 50 and 100 millimetres. The surface plate in such an instance is between 5 and 15 millimetres thick in typical embodiment, and the corrugated plate is preferably similar and within the range of 2 to 10 millimetres thick.

The application of the invention to plate materials and minimisation of the use of rolled stiffener sections is of considerable importance.

It is known for example in aircraft construction to form a sandwich material of thin lightweight metal sheet with corrugated metal reinforcement inside. Such material is normally made by electron beam welding, but there has been a prior proposal to produce the material by a form of spot welding, known as pulse trains, using lasers. However, the overall composite product is very thin (the only example known is 8.7 millimetres thick external dimensions) and is made of extremely thin sheet certainly not exceeding 1 mm in thickness. Also, it is always welded by through welds from the outside inwards, in contrast to the much preferred embodiment of the present invention which welds in one sense, that is to say alternately from the inside outwards and from the outside inwards.

The present invention does not represent therefore a mere change of scale as compared to the above invention. More specifically, the differences are (a) A different type of welding in the prior art, that is to say spot (pulse train) welding as against continuous seam welding, also by a small scale 300 w YAG laser as against a multi-kilowatt $Co_2$ laser, giving two-dimensional welding problems as against three-dimensional in the large scale now proposed.

(b) Different weld directions on different faces in the present invention thus obviating the need to turn over the composite. This is particular importance with a large scale fabrication and also permits a different design of the whole production line with consequent equipment savings (c) A different field of eventual use in ships, buildings, offshore structures, containers, platforms, linkspans, oil rigs, pipelines and other large scale users. The use of sandwich structures in ships etc results in a superior end product from the aspects of weight, strength, headroom, damage from various causes, intactness, cleaning, painting, liquid flow and the transmission of vibration, heat and noise, etc.

(d) The design of joints between sandwich composite panels end-on, side-on, and perpendicular to one another.

(e) The use of sandwich structures in cylindrical or non-cylindrical arcuate shapes as against flat shapes.

(f) The design of penetrations and holes in sandwich structures.

(g) Repair procedures (h) Protective measures against corrosion.

(i) The design of a laser-equipped sandwich panel line.

(j) Different characteristics of welding procedure including the use of paint-primed materials.

As to the last of these laser weld procedure depends upon the total energy input; extent and type of focusing; loss of metal if any by evaporation; plasma formation, or retention, or re-shaping; heat conduction away from the weld; surface tension of molten metal shape; and similar physical or chemical characteristics in the extreme conditions at the point of welding. Most if not all of these conditions are not applicable in at all the same fashion in different scales of working. The Applicants have nonetheless found that through welding on a seam basis can be used and can be used moreover in either direction, that is to say, with the thick sheet before the thin sheet, or with the thin sheet before the thick sheet.

On the large scale it is not practical to depend upon the pressing together of flat plates and corrugated stiffener plate. The through-welding procedure has been developed to cater for gaps between these two component parts. A wire feed system is used to account for such gaps.

Moreover, an option in the finished product is of obtaining one surface free from weld lines and thus being particularly suitable to form the inner surface of containing tanks or holes, or the outer surface of hulls.

In a further aspect welds can be made from inside the sandwich panel and thereby obtain two outer surfaces free from weld lines.

The invention will be further described with reference to the accompanying drawings in which.

Figure 1:
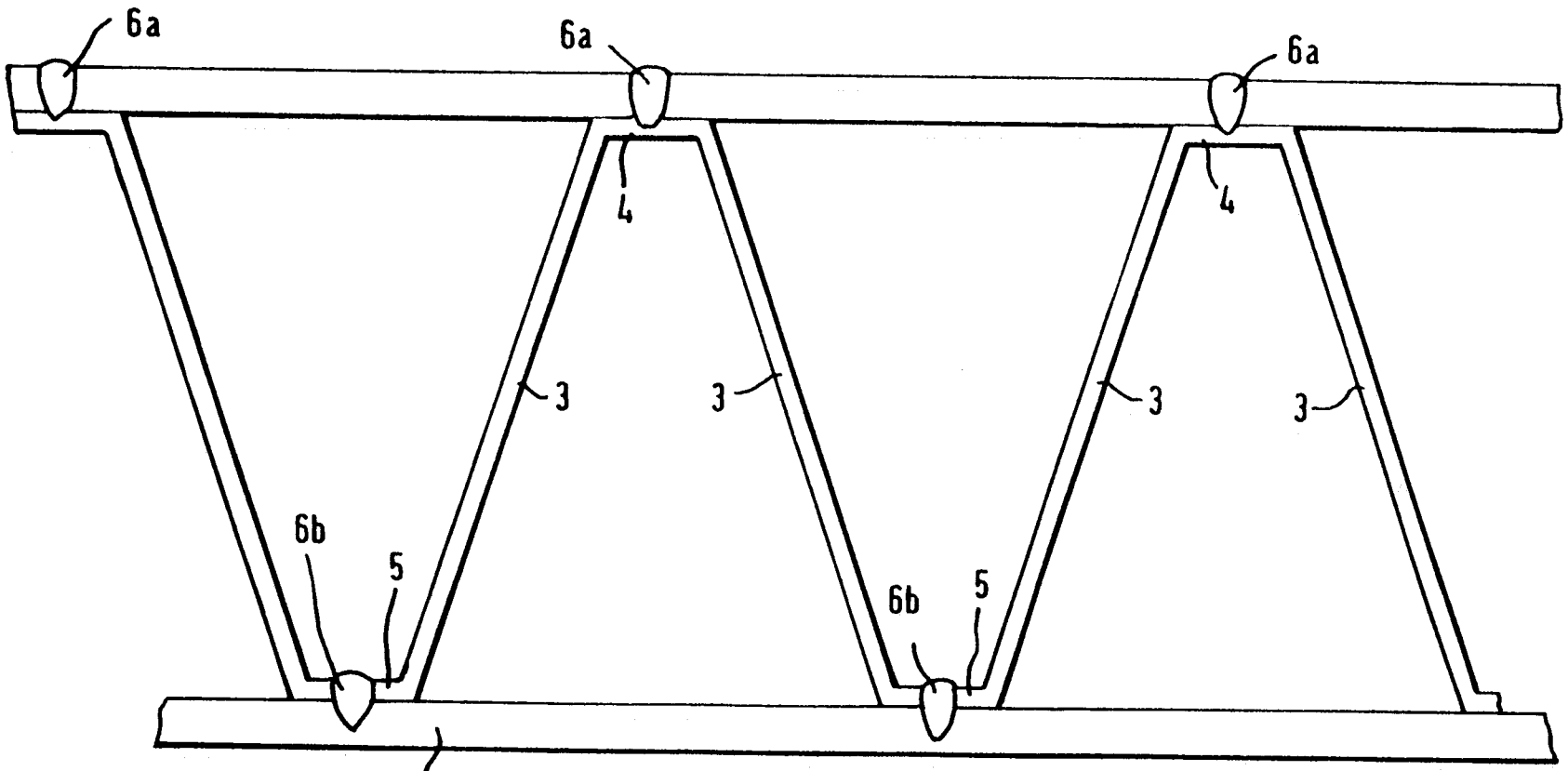
FIG. 1 is a cross-section through part of a composite double-skinned panel according to the invention.

FIG. 1 shows a section through a portion of composite panel in accordance with the invention. The composite panel comprises a top plate 1, a bottom plate 2, and an internal corrugated plate 3, the corrugations of which have, in the instance shown, flattened peaks and troughs 4 and 5 respectively. The plates 1 and 2 are secured to the corrugated plates 3 by laser through-welds referenced at *6a* at the upper plate, and *6b* at the lower plate. Such laser welds can be made by the methods described in our earlier patent Applications, namely by continuous tracking of for example a 10 kilowatt focussed laser beam. As shown, the various welds 6 do not penetrate the underside of the lower plate. It would appear that there is no loss in weld strength if the underside is penetrated, but it is preferable if, at least for the lower welds *6b*, complete penetration is avoided so that an unmarked surface is proVided on at least one side of the composite.

The composite as shown can readily be made by such welding without turning over, utilising the weld beam in a single vertical direction as shown by the arrows. To make such a composite, the lower plate 2 is positioned as required, the corrugated plate 3 is placed upon it and welded along each trough 5 to form the weld *6b*, and the plate 1 is placed over the corrugated plate and welded along each peak 4 to form the weld *6a*. Since the peaks and troughs are flat they readily lend themselves to such welding, and since they are regularly spaced it is simple to arrange the laser welding head to follow the underlying course of the fattened peak 4 even though the peak itself may be covered by plate 1.

The sandwich composite as shown can be made in a number of different relatively large scale sizes, and is not to be confused with the very thin metal skin, typically less than 10 millimetres in overall thickness, produced for aerospace purposes. Typically, the sandwich composite of the invention has an internal spacing dimension between the opposed inner faces of plates 1 and 2 of 50 or 100 millimetres, and a corrugation pitch of an equivalent amount, from, for example, the mid points of each peak to the next peak. The thicknesses of plate can vary, as previously indicated, depending upon the strength of sandwich composite that is required. In the example the thicknesses are for plates 1 and 2 are 8 millimetres thick, and plate 3 is 3 millimetres thick.

Figure 2:
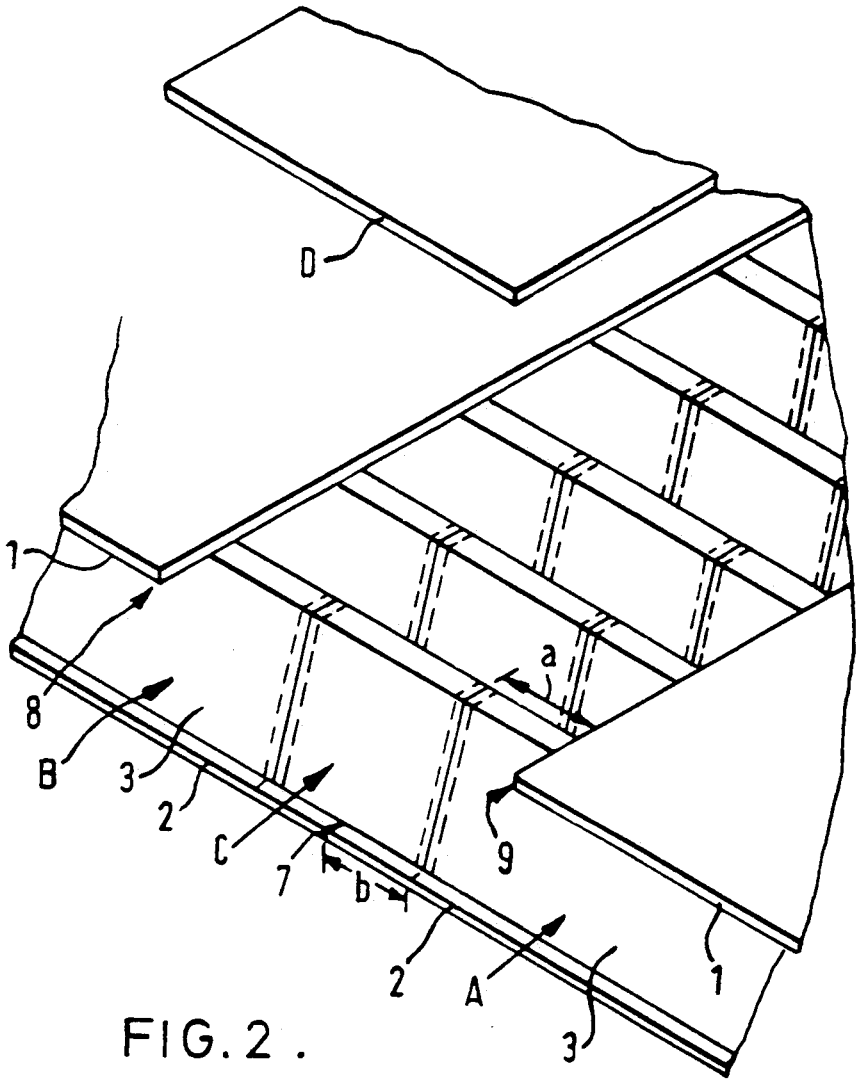
FIGS. 2 and 2*a* show forms of transverse assembly of the composite of FIG. 1, in perspective view.

FIGS. 2 and *2a* shows methods of joining such a composite panel to an adjacent such panel by welding of a transverse connection. While several methods are possible, it has been found by the Applicants that one of the methods as shown is to be preferred.

With reference to FIG. 2, Alternative 1:-in this attachment procedure, composite panels A and B are utilised. As before, each possesses a top plate 1, a corrugated plate 3 and a lower plate 2. The end configuration of the panels will be apparent from FIG. 2, being such that the corrugations 3 project by a distance (a) beyond the edge of plate 1, and that plate 2 projects by a distance (b) beyond the ends of the corrugations. The two panels A and B, of these particular end configurations, are united with the help of a corrugated insert C and a closing plate D. The insert C has a total width of twice the distance (b) (minus any weld gap requirements) and is used to fill the gap between the ends of the corrugations of panels A and B. As shown in dotted lines, backing corrugation strips (not shown) may be used depending upon the welding process adopted. The closing plate D has a total width of (2b+2a) (again, minus any weld gap requirements) and is used to fill the gap between two top plates on panels A and B. The plates may have such edge preparations as necessary for the welding process used.

To assemble two such panels, the first weld to be made would be the lower face plate butt weld one end of which is shown at 7, which can be done by laser or by a conventional process such as a manual metal arc or submerged arc if necessary. The second welds to be made would be the two sets of butt welds between the corrugated plates 3 and insert C. The final welds would be two further butt welds at 8 and 9 when the closing plate D is placed in position. If appropriate in a particular application laser welds could be incorporated along some or all of the peaks and troughs of such an intermediate structure. In between the various welding operations the activities of cleaning, inspection and anti-corrosion treatment may be carried out as known per se.

With reference to FIG. *2a*, Alternative 2, there is shown a second method of joining such a composite panel to an adjacent such panel by the welding in of a transverse connection.

In this attachment procedure composite panels A and B are utilised as in Alternative 1. The two panels A and B of this particular end configuration, are again united with the help of a corrugated insert C, closing plate D, but additionally stopper plates E1 and E2 are utilised. The stopper plates have a height equal to the depth of the corrugated plate minus the thickness of the corrugated plate.

The insert C has a total width of twice the distance (b) minus twice the thickness of the stopper plate plus any gaps required by processes. The closing plate D has a total width (2b+2a) minus any gaps required by processes and is used to fill the gap between the two top plates on panels A and B.

To assemble two such panels the first weld to be made would be the lower face plate butt, one end of which is shown at 7, which can be done by high power density laser or conventional welding processes. The second substantive welds to be made would be the two sets of butt welds between the corrugated insert C and the stopper plates E1 and E2, which would have been previously laser welded to the corrugated plate 3 during the fabrication sequence. The final welds would be two further butt welds at 8 and 9 when the closing plate D is placed in position. If appropriate in a particular application laser welds could be incorporated along some or all of the peaks and troughs of such an intermediate structure.

In between the various welding operations the activities of cleaning, inspection and anti-corrosion may again be carried out.

Figure 3:
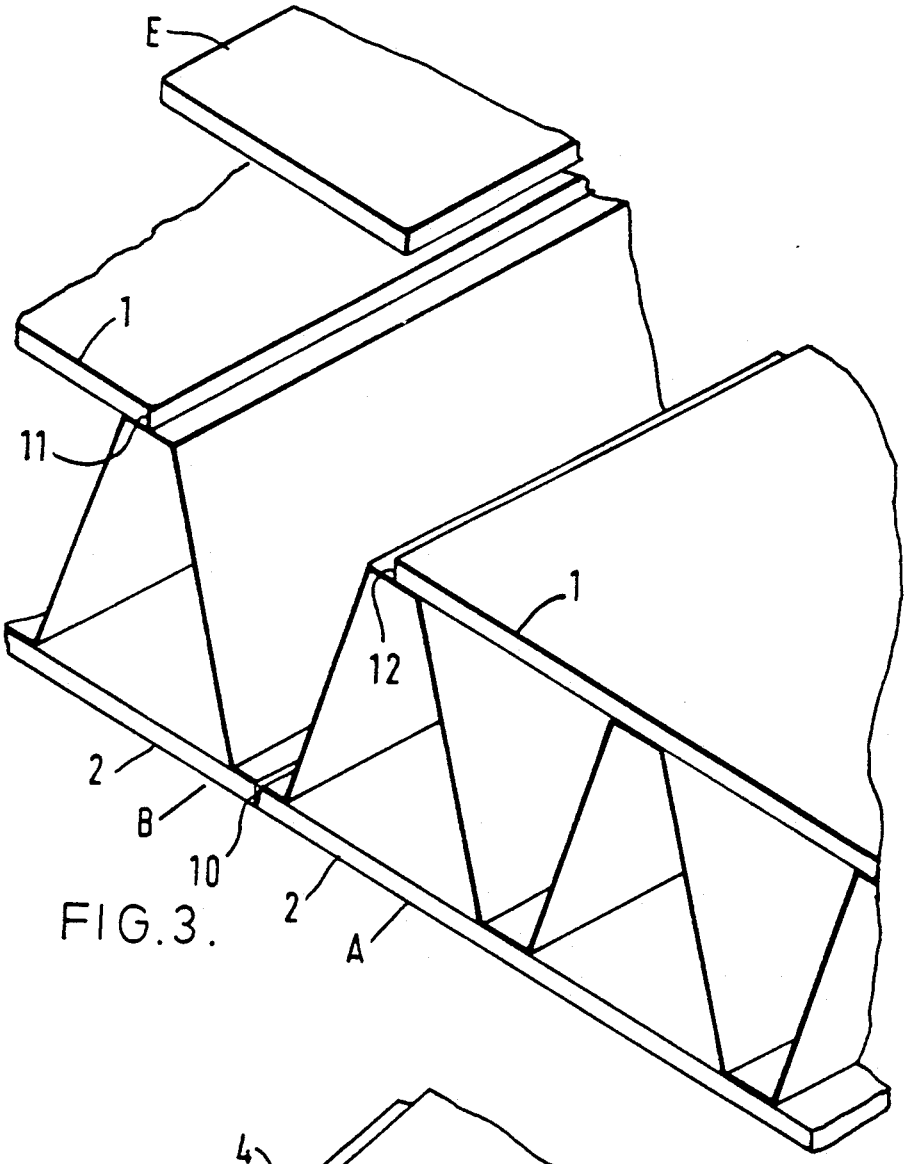
FIG. 3 shows one form of longitudinal assembly of the composite of FIG. 1, in perspective view.

FIG. 3 shows the joining of two composite panels A and B in a longitudinal manner. The procedure to make such a connection is considerably simpler than that for a transverse connection as shown in FIGS. 2 and *2a*, the first weld being a butt weld 10 and the second weld being two similar butt welds 11 and 12 when the closing plate E is in position. It will be apparent from FIG. 3 therefore, that both the upper and lower plates 1, 2 preferably terminate approximately halfway across a peak or trough respectively. The plates may have edge preparations as required by the welding processes.

Figure 4:
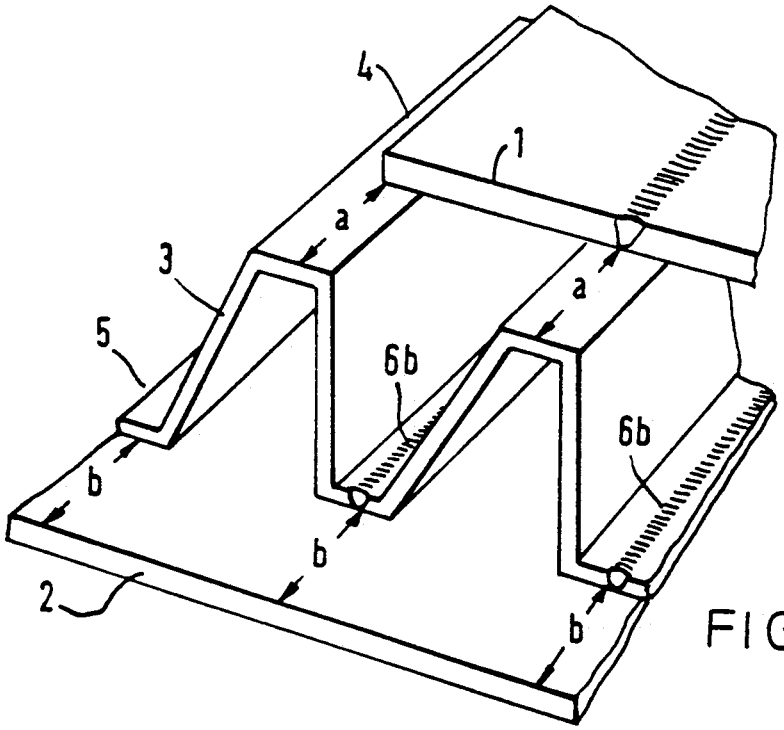
FIG. 4 shows a perspective view of a preferred corner configuration of the panel facilitating fixing as in FIGS. 2 and 3.

FIG. 4 shows a corner of a composite panel in accordance with the invention, showing a preferred configuration of upper and lower plates 1 and 2, in relation to corrugated plate 3, at this location. As will be apparent from a consideration of FIGS. 2, and *2a* and 3, it is preferred for the top plate 1 to terminate at a distance (a) from the ends of the corrugations, and for the bottom plate 2 to project for a distance (b) beyond such corrugations. It is also preferred, but not essential, for the top plate 1 to finish approximately halfway across a peak 4, as shown and it is preferred for the bottom plate 2 to finish similarly approximatately halfway across a trough 5.

Figure 2A:
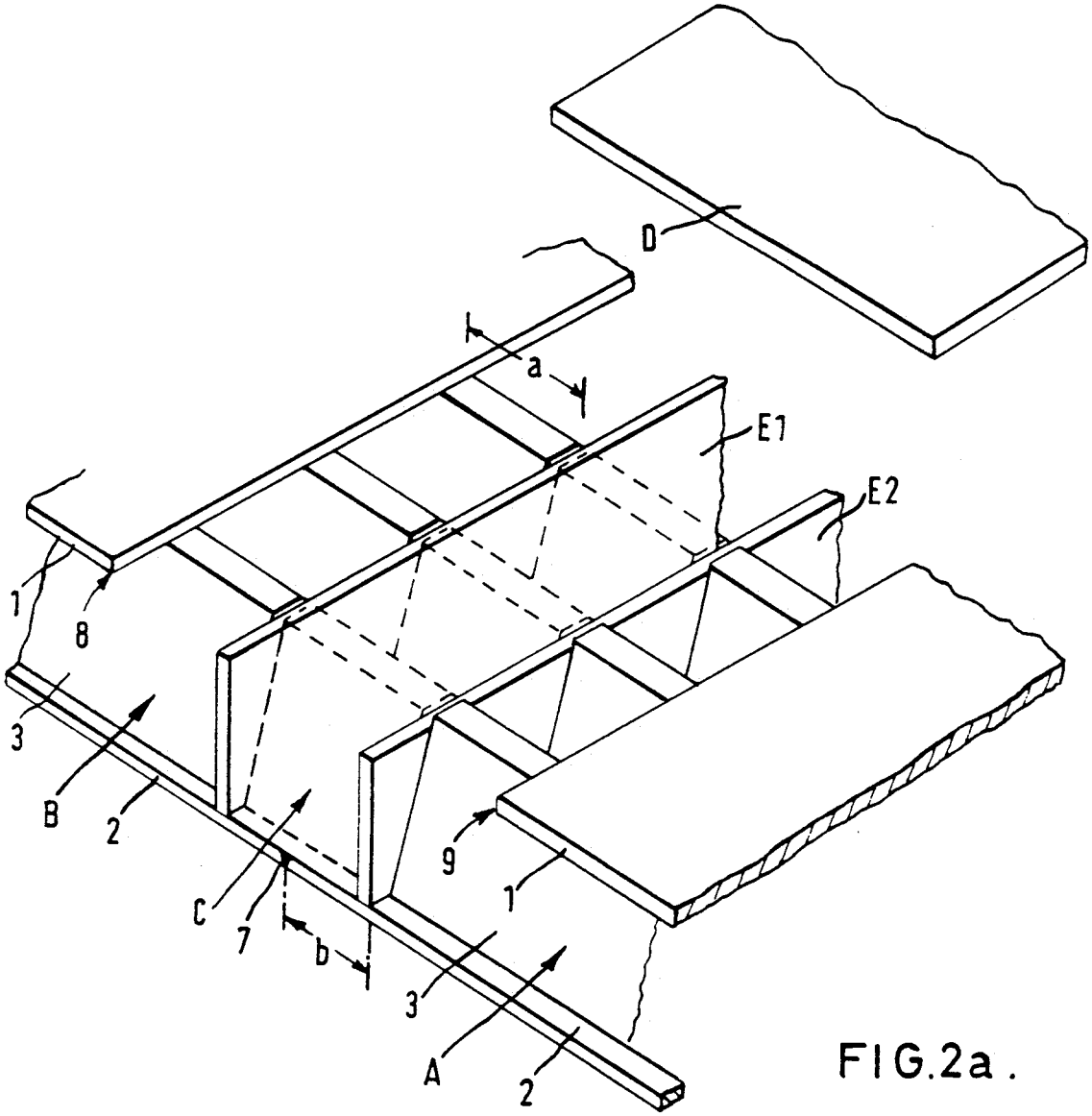

It will be appreciated therefore that a composite panel of the type of cross-section generally as shown in FIG. 1, and having the corner configurations generally as shown in FIG. 4, is a particular valuable embodiment of the present invention. It will also be appreciated that Alternative 2 (FIG. 2*a*) simply adds a stopper plate to the end of the corrugated plate 3.

Figure 5:
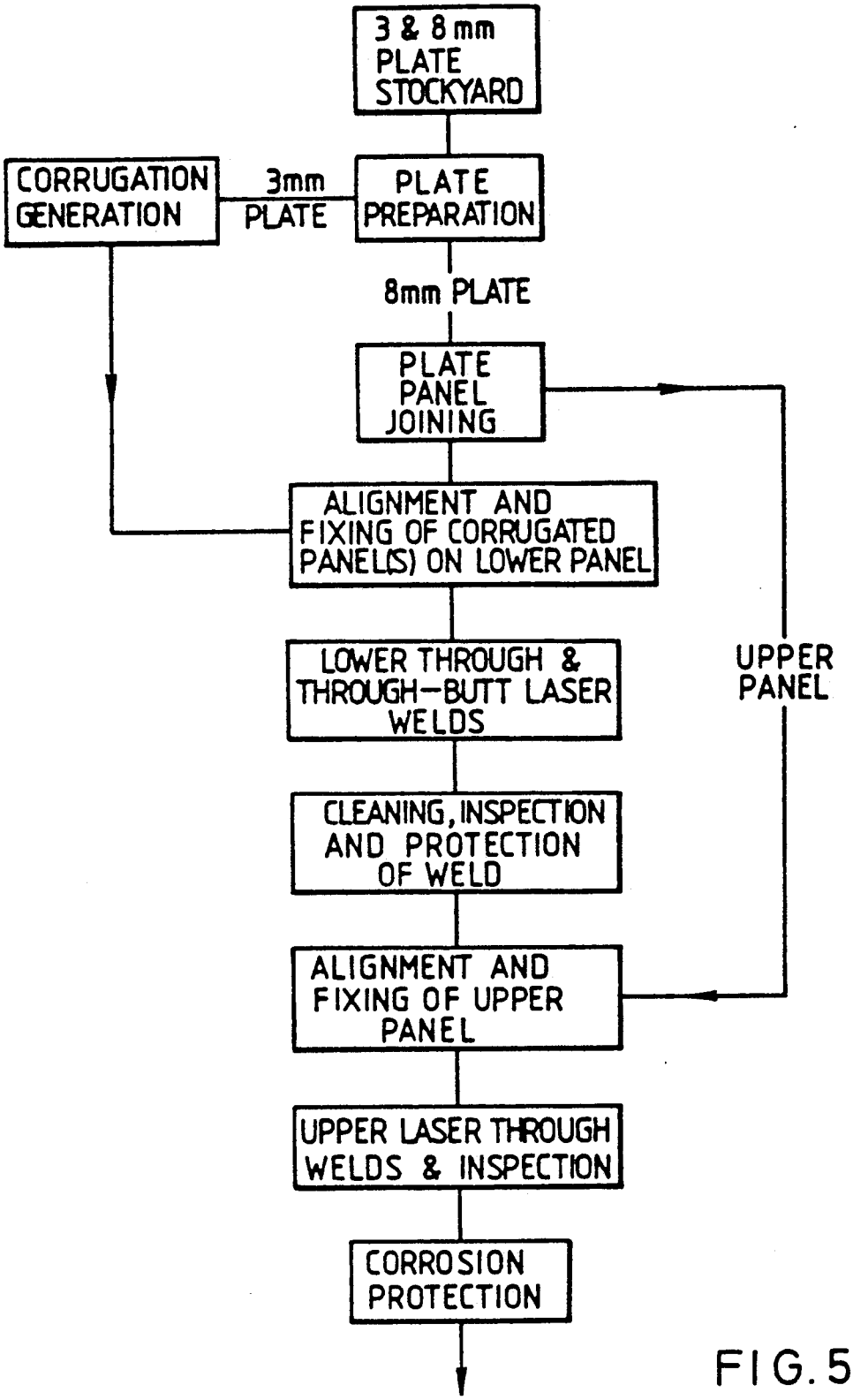
FIG. 5 shows a flow sheet of a flat fabrication sequence.

FIG. 5 is a flow chart showing a typical composite sandwich panel fabrication sequence.

The example sequence shown is developed for the fabrication of a standard unit panel and is designed to permit a throughput capacity of a composite panel at regular intervals using an appropriate laser power per unit with sufficient units arranged as necessary.

The 3-millimetre and 8 millimetre plates are taken from the stock yard, levelled and cleaned. Following this stage they are sent on separate paths. The 3-millimetre plate is sent to cold-rolling or other process for formation of the necessary corrugations.

The 8-millimetre plate is cut to precise size and butt-welded to form a panel of plate. The panels are split into two streams. One face plate panel stream, destined to be the lower panel of plate, receives the corrugated plate, and after tack welding is welded through the flat troughs of the corrugated plate to form the initial part of the composite. Butt through welds (see FIG. 8) may be required to join corrugations to face plate if more than one corrugated plate is to be used, unless of course they are already welded together prior to fixing on the lower face plate. The other plate panel stream gives the other plate panels which are positioned on top of the partly formed composite and laser through-welded through the plate along the flattened peaks of the corrugations. This gives the complete composite panel. During or after such fabrication various corrosion resistance measures may be applied. Some of these may necessitate action prior to welding the upper face plate into position, and some after.

Figure 6:
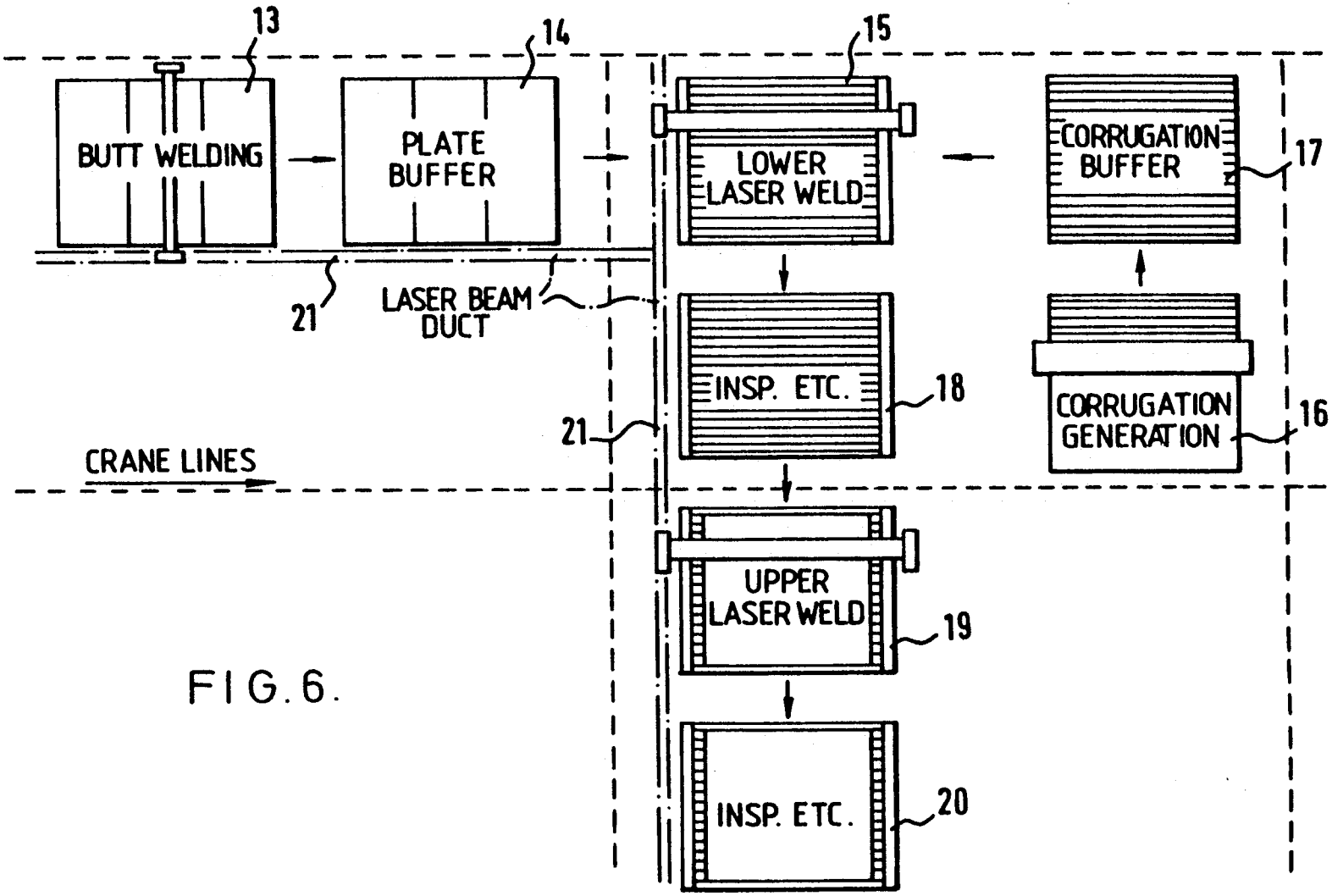
FIG. 6 shows a diagram of one arrangement of a production line for making such composites; in a particular application other design solutions may be adopted.

FIG. 6 shows diagrammatically a sample production line for such panels. Plates are butt welded into upper and lower panels at 13, held in a buffer store at 14, and then moved to weld station 15. Further panels are also fed, to overlie the flat panels, from the corrugation generation equipment 16 via a buffer 17. The aligned corrugated stiffeners are at this point held down on the underlying plate and the subassembly laser welded in the troughs of the corrugations. Attention is drawn to the projection of the lower plate beyond the end of the corrugations, as shown in FIG. 4 above. The sub assembly moves to inspection 18. Top panels are then placed upon the corrugations (again to leave a certain proportion of corrugation projecting, as shown at station 19) and welding is effected along the peaks through the uppermost plate panel. Finally, the assembly moves to inspection station 20.

Provision is made, as shown in FIG. 6, for an overhead lifting facility for the individual panels and corrugated stiffening. Nonetheless, this facility can consist in a simple lifting and transfer arrangement, and it is not normally necessary to turn over the panels at any stage in their fabrication. The whole sandwich line may be mechanised and automated.

Attention is drawn to the laser beam ducts 21. In the practice of this invention, as described in their earlier Application, it is envisaged to have a central laser generator and to transmit an unfocused laser beam down a duct common to all of the processing installations, the beam being selectively intercepted and thereafter directed along a duct on a gantry to be focused by optics on to a workpiece.

Figure 8:
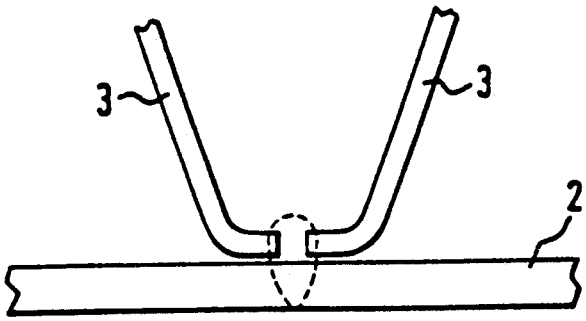
FIG. 8 shows a laser-welded butt-through joint.

FIG. 8 shows how a high power density laser beam may be used to produce a weld which butts together two corrugated plates 3 whilst at the same time creating a through connection between the corrugated plates 3 and the lower face plate 2.

This joint configuration "Butt-through weld", may be used to join corrugated plates in order to manufacture a sandwich composite structure.

The composite panels made in accordance with the invention have generally smooth external surfaces, are smaller in overall thickness dimension than existing forms of large structures, and in the end product i.e. ship or other are of considerably quicker fabrication time and prime cost. In addition to these advantages, they are of a structure considerably simplified for cleaning and painting processes. Thus, the external surfaces are smooth apart from weld configurations and present fewer problems of corrosion protection. Moreover, the internal surfaces are in effect simple polygonally sectioned tubed surfaces and can be filled with a paint or anti-corrosion material such as a foam, vapour, gas etc.

The type of composite panels shown can be used as it stands for the tank top of a dry cargo ship, or for similar structures. In principle, the sandwich form could be applied to bottom shell, side shell decks, longitudinal bulkheads, transverse bulkheads, flats, platforms, superstructures, deck houses, etc. These main and minor structural members may require further supporting members, in which case these may be conventional stiffened webs or a second such sandwich panel structure spaced from the first. For example, initial studies have indicated that a flat 12 millimetre transverse floor structure supported by 180 millimetre by 12 millimetre flat bars spaced at 600 millimetres could be replaced by a 50 millimetre deep sandwich as shown comprising 3-millimetre corrugated central plate welded between 6-millimetre face plates.

Composite panels of the invention as shown could also be made to follow a curved or part cylindrical path. This would require the production of arcuate surface plates and the formation of the corrugated stiffener plates to follow the same arcuate line. While the former plates are within the ambit of conventional fabrication techniques, the latter represent a less common fabrication, which may be carried out, for example, by providing tapered corrugations and pressing them around a former to give a conic development or by the use of tapered inserts.

Figure 7:
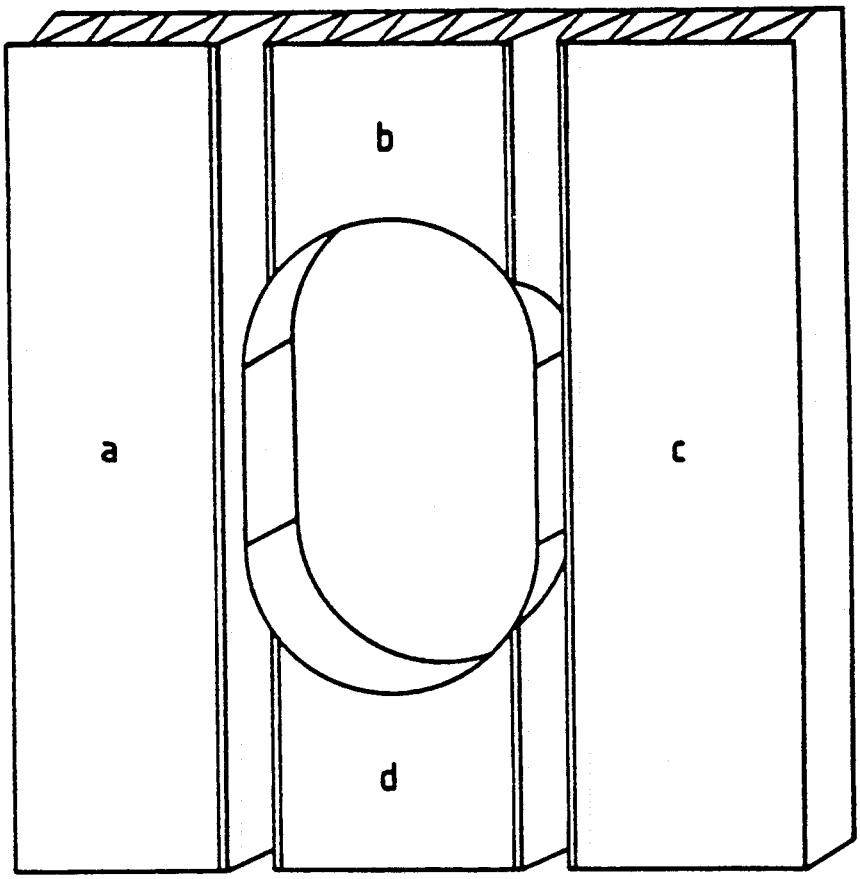
FIG. 7 shows a hole for ducting or hatchway access formed through a composite panel according to the present invention.

FIG. 7 shows three assembled corrugated panels (the upper closing plates E of which have been omitted for clarity) provided at the fabrication stage with an elliptical access manhole 17. The side pieces of the main panel are indicated by reference letters a and c while the upper and lower semi-circular hole pieces are indicated by reference letters b and d. Such panels can be fabricated as necessary by a variant of the production line described above and be incorporated into the eventual structure where desired. It is alternatively possible to provide postcutting of holes, since the structure is overall sufficiently rigid to withstand reasonable loss of integrity in this fashion.

I claim:

1. A composite structure having a metal panel comprising first and second parallel plates having opposing faces, a corrugated metal stiffener sandwiched between said plates and having a plurality of parallel corrugations defining peaks and troughs, each corrugation having an end, said first and second plates being secured to the peaks and troughs, respectively, of said stiffener by weld lines extending along the peaks and troughs, said panel being assembled to a like panel with the corrugations of both panels aligned end-to-end, with straight edges of said first plates opposing one another, and with straight edges of said second plates opposing one another: wherein said straight edge of each first plate extends parallel to and forwardly of a plane containing the ends of the corrugations of the respective panel, and said straight edge of each second plate extends parallel to and rearwardly of said plane, and (a) a butt weld joins said first plate edges (b) a corrugated insert piece is joined at each of said opposing faces by butt welds to the ends of the corrugations on the respective panels and (c) a plate insert is butt-welded at parallel edges thereof to said straight edges of said second plates.

2. A panel assembly as claimed in claim 1 in which said corrugated insert piece includes peaks and valleys, and welds along the peaks and valleys of said corrugated insert piece.

3. A composite structure having a metal plane comprising first and second parallel plates having opposing faces, a corrugated metal stiffener sandwiched between said plates and having a plurality of parallel corrugations defining peaks and troughs, said first and second plates being secured to the peaks and troughs, respectively, of said stiffener by weld lines extending along the peaks and troughs, said panel being assembled to a like panel with straight edges of said first plates opposed to one another and with straight edges of said second plates opposed to one another, wherein opposed straight edges of said first parallel plates are spaced forwardly of opposed straight edges of said second parallel plates, and (a) a butt weld joins the first parallel plate opposed edges (b) a plate insert is butt-welded at parallel edges thereof to the respective opposed straight edges of the second parallel plates.

4. A composite metal panel having two faces and consisting of:

a first metal plate of at least 1 mm in thickness;

a stiffener plate of at least 1 mm in thickness, said stiffener plate being configured with a plurality of parallel corrugations constituting peaks and troughs, wherein said corrugations have ends and each of said peaks and troughs has a center, said stiffener plate being welded to the first metal plate by laser welds extending along said troughs, through the thickness of the stiffener plate and into the first metal plate; and a second metal plate of at least 1 mm in thickness, said second metal plate also being welded to the stiffener plate by laser welds extending in parallel lines along the second metal plate, through the thickness thereof, and into and along said peaks of the stiffener plate;

wherein (a) a straight end edge of said first plate is transverse to the corrugations and is parallel to and spaced forwardly of a plane containing the ends of the corrugations, and a straight end edge of said second plate is transverse to the corrugations and is parallel to and spaced rearwardly of said plane and (b) another straight edge of said first plate extends substantially along the center of a trough in a corrugation and another straight edge of said second plate extends substantially along the center of a peak in a corrugation.

* * * * *